US006045391A

United States Patent [19]

Jaag

[11] Patent Number: 6,045,391

[45] Date of Patent: Apr. 4, 2000

[54] MULTI-POLE CONNECTING TERMINAL FOR ELECTRICAL CONDUCTORS

[75] Inventor: Dieter Jaag, Villingen-Schwenningen, Germany

[73] Assignee: Ria Electronic Albert Metz, Germany

[21] Appl. No.: 09/120,397

[22] Filed: Jul. 22, 1998

[30] Foreign Application Priority Data

May 27, 1998 [DE] Germany ..... 198 23 647

[51] Int. Cl.[7] ..... H01R 4/24

[52] U.S. Cl. ..... 439/405; 439/417

[58] Field of Search ..... 439/404, 405, 439/410, 417

[56] References Cited

U.S. PATENT DOCUMENTS 3,985,416 10/1976 Dola et al. ..... 439/417
4,068,912 1/1978 Hudson, Jr. et al. ..... 439/405
4,209,219 6/1980 Proietto ..... 439/405
4,697,862 10/1987 Hasircoglu ..... 439/404
4,758,536 7/1988 Miller et al. ..... 439/138
5,766,033 6/1998 Davis ..... 439/405

*Primary Examiner*—Lincoln Donovan
*Assistant Examiner*—Michael C. Zarroli
*Attorney, Agent, or Firm*—Eugene E. Renz, Jr. PC

[57] ABSTRACT

A multipole connecting terminal for electrical conductors is described, which consists of a receptacle block (10) and a contact block (12). The receptacle block (10) has receiving channels (14.1, 14.2) arranged in two rows for the conductors (15). The insulation displacement contacts (20) of the contact block (12) pass through the contact channels (18) of the receptacle block (10) and make contact with the conductors (15) in the receiving channels (14). The receptacle block (10) is made up of two component blocks (10.1, 10.2).

7 Claims, 1 Drawing Sheet

MULTI-POLE CONNECTING TERMINAL FOR ELECTRICAL CONDUCTORS

FIELD OF THE INVENTION

The invention pertains to a multipole connecting terminal for electrical conductors according to the introductory clause of claim 1.

BACKGROUND OF THE INVENTION

Connecting terminals of this type make it possible to connect multiple electrical conductors such as the wires of a multiwire cable quickly and easily. For this purpose, the individual conductors are inserted into the receiving channels of a receptacle block, and then a contact block with insulation displacement-type contacts is set down onto the receptacle block so that the insulation displacement contacts can pass through the contact channels of the receptacle block and make contact with the conductors which have been inserted into the receiving channels. A connecting terminal of this type is known from, for example, DE 93-10,211 U1.

DE197-03,381 C1 describes a connecting terminal of this type, in which the receiving channels are arranged in two parallel rows a certain distance apart so that a larger number of conductors can be connected in a smaller amount of space. To achieve the most space-saving arrangement of the receiving channels, the receiving channels of the second or top row are staggered with respect to the receiving channels of the first row.

SUMMARY OF THE INVENTION

The contact channels and the insulation displacement contacts are at a slant to the axis of the receiving channels, so that the spacing of the receiving channels of the first or bottom row can be made smaller without allowing the contact channels assigned to the receiving channels of the second or top row to penetrate into the receiving channels of the first or bottom row.

The invention is based on the task of making available a multipole connecting terminal of the general type described above which makes it possible to connect a larger number of conductors in a small amount of space.

The task is achieved according to the invention by means of a connecting terminal with the features of claim 1.

Advantageous embodiments of the invention are described in the subclaims.

The essential idea of the invention consists in designing the receptacle block as an assembly of two component blocks, i.e., a first component block, which holds the first row of receiving channels, and a second component block, which faces the contact block and holds the second row of receiving channels. The two-part design of the receptacle block makes it possible for the contact channels passing through the second component block to be perpendicular to the axis of the receiving channels without the penetration of these contact channels into the receiving channels of the first component block. Because, as a result of this design measure, the contact channels assigned to the second row of receiving channels facing the contact block cannot penetrate into the receiving channels of the first row, it is possible for the contact channels assigned to the second row of receiving channels to be arranged in such a way that they overlap the receiving channels of the first row. A smaller spacing between the receiving channels within the two rows can therefore be allowed. In addition, the insulation displacement contacts and thus the contact channels can be perpendicular to the axis of the receiving channels, as a result of which the depth of the connecting terminal in the direction of the receiving channels can be reduced, and the ability of the insulation displacement contacts to make contact with the conductors is improved.

The contact channels assigned to the two rows of receiving channels and accordingly the insulation displacement contacts assigned to the two rows of receiving channels are preferably arranged in two rows, which are a certain distance apart in the axial direction of the receiving channels. The insulation displacement contacts and the contact channels assigned to the first row of receiving channels, i.e., the row which is farther away from the contact block, are located, looking in the direction in which the conductors are inserted, behind the insulation displacement contacts and the contact channels of the second row. The receiving channels of this second row can therefore come to an end axially before the contact channels of the first row do, with the result that the contact channels assigned to the receiving channels of the first row will not penetrate the receiving channels of the second row even when the two rows overlap.

It is advisable for the receiving channels of the second row to be staggered with respect to the receiving channels of the first row. As a result, while the spacing of the receiving channels and thus of the conductors within the two rows remains the same, the distance between the receiving channels and conductors of the first row from those of the second row is increased. Without any change in the overall dimensions, therefore, it is possible to increase the creepage distance and the flashover distance.

In an advantageous embodiment, the second component block is not as deep in the axial direction of the receiving channels [as the first component block—Tr. Ed.], so that, looking in the direction in which the conductors are inserted, it ends before the back row of insulation displacement contacts. As a result, the amount of material required to produce the component is reduced.

The first and second component blocks are preferably assembled by snapping them together. For this purpose, locking springs, for example, on one of the component blocks engage in locking recesses in the other component block. Guide pins can facilitate assembly and ensure exact positioning.

BRIEF DESCRIPTION OF THE DRAWINGS

In the following, the invention is described in greater detail on the basis of an exemplary embodiment, which is illustrated in the drawing.

DETAILED DESCRIPTION OF THE PREFERRED EMBODIMENT

Figure 1:
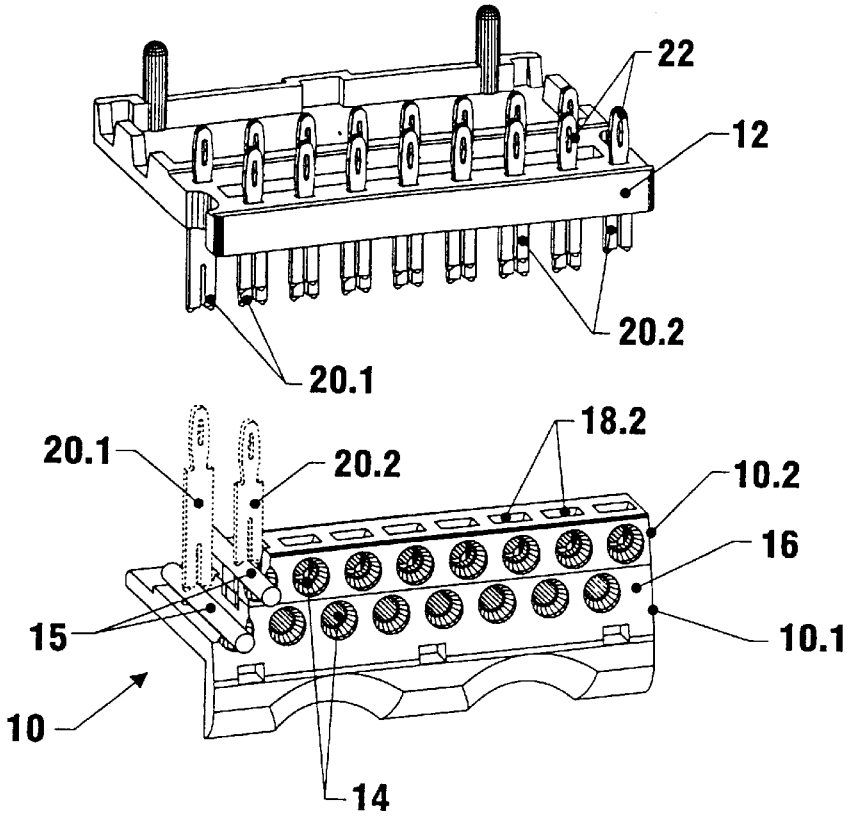
FIG. 1 shows a perspective view of the connecting terminal before the contact block is set down onto the receptacle block.

The connecting terminal consists of a receptacle block 10 and a contact block 12, both being made as injection-molded plastic parts. Receptacle block 10 has receiving channels 14, which lead into receptacle block 10 at a right angle from one end surface 16 of receptacle block 10. Receiving channels 14 allow the insertion of electrical conductors 15, e.g., the wires of a multi-wire cable. Contact channels 18 lead from the surface of receptacle block 10 facing contact block 12 into receptacle block 10; these channels are perpendicular to the axis of receiving channels 14 and intersect them.

Insulation displacement contacts 20 are molded in place in contact block 12; these contacts project out from contact block 12 from the side of contact block 12 which faces receptacle block 12 in such a way that they are able to pass through contact channels 18 of receptacle block 10 when contact block 12 is set down onto receptacle block 10 and thus make contact with the conductors which have been inserted into receiving channels 14. On the side of contact block 12 facing away from receptacle block 10, insulation displacement contacts 20 are provided with solder-type terminals 22, which project out from the surface of contact block 12.

Figure 2:
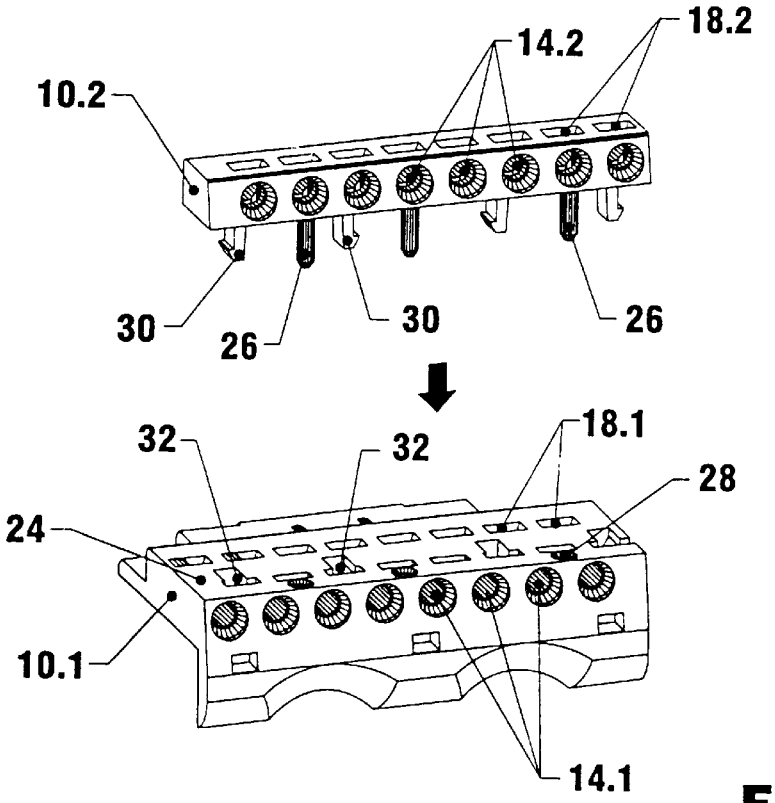
FIG. 2 shows a perspective view of the receptacle block before the component blocks are assembled.

As FIG. 2 shows, receptacle block 10 consists of a first component block 10.1 and a second component block 10.2. First component block 10.2 and second component block 10.1 are in contact with each other along a parting plane 24, which is parallel to receiving channels 14 and perpendicular to contact channels 18. Second component block 10.2 has guide pins 26, which are perpendicular to parting plane 24 and point toward first component block 10.1; these pins fit into guide holes 28 in first component block 10.1 during assembly. This arrangement facilitates the assembly of component blocks 10.1 and 10.2, and it also ensures that components block 10.1 and 10.2 are positioned precisely with respect to each other in the assembled state. In addition, second component block 10.2 has locking springs 30, which are perpendicular to parting plane 24 and point toward first component block 10.1; when component blocks 10.1 and 10.2 are being assembled, these springs snap into corresponding locking recesses 32 in first component block 10.1 and thus lock component blocks 10.1 and 10.2 undetachably together, so that receptacle block 10 shown in FIG. 1 is formed.

A first row of receiving channels 14.1 is arranged in first component block 10.1; these receiving channels 14.1 are arranged in a row parallel to parting plane 24 and are all the same distance apart. Receiving channels 14.1 pass axially all the way through first component block 10.1.

In second component block 10.2, a second row of receiving channels 14.2 is provided, which are also arranged in a row parallel to parting plane 24. The spacing between these channels is the same as that of receiving channels 14.1 of the first row. In the assembled state of receptacle block 10, receiving channels 14.2 of the second row are staggered with respect to receiving channels 14.1 of the first row; that is, in a projection looking in the direction of contact channels 18, each receiving channel 14.2 of the second row falls in the middle between two receiving channels 14.1 of the first row.

Second component block 10.2 is not as deep in the axial direction of receiving channels 14 as first component block 10.1. After receptacle block 10 has been assembled, the end surfaces 16 of the two component blocks 10.1 and 10.2 are flush with each other. In the insertion direction of receiving channels 14, however, second component block 10.2 ends approximately in the middle of first component block 10.1. Receiving channels 14.2 extending through second component block 10.2 thus also terminate halfway along the axial length of receiving channels 14.1 of first component block 10.1.

Contact channels 18 and insulation displacement contacts 20 are also arranged in two rows, consisting of contact channels 18.1, 18.2 and of insulation displacement contacts 20.1, 20.2. Contact channels 18.1 are located behind second component block 10.2 in a row parallel to end surface 16 in such a way that each contact channel 18.1 intersects one of receiving channels 14.1 at a right angle. The second row of contact channels 18.2 is provided in the second component block 10.2, where again these contact channels 18.2 are arranged in a row parallel to end surface 16, and each contact channel 18.2 intersects a receiving channel 14.2 at a right angle. The width of contact channels 18 is somewhat greater than the diameter of the circular cross section of receiving channels 14, the surface of contact channels 18 being perpendicular to the axis of receiving channels 14.

The two rows of insulation displacement contacts 20.1 and 20.2 are arranged correspondingly, so that, when contact block 12 is set down onto receptacle block 10, insulation displacement contacts 20.1 of the first row pass through contact channels 18.1 in first component block 10.1, and insulation displacement contacts 20.2 of the second row pass through contact channels 18.2 of second component block 10.2. In correspondence with the distance between the first row of receiving channels 14.1 and the second row of receiving channels 14.2, insulation displacement contacts 20.1 of the first row are longer than insulation displacement contacts 20.2 of the second row. When contact block 12 is set down onto receptacle block 10, therefore, insulation displacement contacts 20.1 pass through contact channels 18.1 of first component block 10.1, whereas insulation displacement contacts 20.2 of the second row pass through contact channels 18.2 of second component block 10.2 and terminate at parting plane 24.

I claim:

1. In multipole connecting terminal for electrical conductors with a plastic receptacle block (10); with a plastic contact block (12), which can be set onto the receptacle block (10); with receiving channels (14) for the conductors (15), which start at one end surface (16) of the receptacle block (10) and lead into the receptacle block (10), and which are arrayed in a first row (14.2) and a parallel second row (14.2) a certain distance apart; with contact channels (18), which start at the surface of the receptacle block (10) facing the contact block (12) and extend into the receptacle block (10), where each contact channel (18) intersects an associated receiving channel (14) at a right angle; and with insulation displacement contacts (20), which are arranged in the contact block (12) and which project from the surface of the contact block (12) facing the receptacle block (10) in an arrangement corresponding to the arrangement of the contact channels (18), these contacts being of such a length that, when the contact block (12) is set down onto the receptacle block (10), the insulation displacement contacts (20) are able to pass through the contact channels (18) of the receptacle block (10) and make contact with the conductors (15), which have been introduced into the receiving channels (14), characterized in that the receptacle block (10) has a first component block (10.1) and a second component block (10.2), which are produced as separate injection-molded parts and which are assembled with a parting plane (24) extending between the first row of receiving channels (14.1) and the second row of receiving channels (14.2), said contact channels (18) being arranged in two rows which are separated from each other by a certain distance in the axial direction of the receiving channels (14), one row of contact channels (18.1) being assigned to the receiving channels (14.1) of the first component block (10.1), the second row of contact channels (18.2) being assigned to the receiving channels (14.2) of the second component block (10.2), and in wherein the insulation displacement contacts are arranged in two corresponding rows (20.1, 20.2).

2. Connecting terminal according to claim 1, characterized in that the second component block (10.2) is located on the side of the receptacle block (10) facing the contact block (12), and in that the contact channels (18.1) of the first component block (10.1) are, looking the axial direction of the receiving channels (14), behind the receiving channels (14.2) of the second component block (10.2).

3. Connecting terminal according to claim 2, characterized in that the second component block (10.2) is not as deep in the axial direction of the receiving channels (14) as the first component block (10.1) and, looking in the axial direction of the receiving channels (14), ends before the contact channels (18.1) of the first component block (10.1).

4. Connecting terminal according to claim 1, characterized in that the receiving channels of the first row (14.1) and of the second row (14.2) have the same mutual spacing and in that the row of receiving channels (14.2) of the second component block (10.2) are staggered with respect to the receiving channels (14.1) of the first component block (10.1) by an amount equal to half the spacing interval.

5. Connecting terminal according to claim 1, characterized in that the contact channels (18) and correspondingly the insulation displacement contacts (20) are arranged in such a way that their plane is perpendicular to the axis of the receiving channels (14).

6. Connecting terminal according to claim 1, characterized in that the first component block (10.1) and the second component block (10.2) are assembled by means of a snap connection (30, 32) so that they are locked undetachably together.

7. Connecting terminal according to claim 1, characterized in that guide means (26, 28) serve to guide and position the first component block (10.1) and the second component block (10.2) during the assembly process.

* * * * *